United States Patent [19]

Walse et al.

[11] Patent Number: 4,780,093

[45] Date of Patent: Oct. 25, 1988

[54] ELECTRICAL CONNECTOR ASSEMBLY AND METHOD OF MAKING

[75] Inventors: Alan S. Walse, LaGrange; John Stipanuk, Glen Ellyn, both of Ill.

[73] Assignee: Molex Incorporated, Lisle, Ill.

[21] Appl. No.: 899,840

[22] Filed: Aug. 25, 1986

Related U.S. Application Data

[62] Division of Ser. No. 818,160, Jan. 13, 1986, abandoned.

[51] Int. Cl.[4] ..... H01R 4/24; H01R 43/04

[52] U.S. Cl. ..... 439/418; 29/881; 439/61

[58] Field of Search ..... 29/881, 832, 836, 876, 29/878; 439/59, 60, 61, 62, 418, 425, 634

[56] References Cited

U.S. PATENT DOCUMENTS 3,092,715 6/1963 Hallas .
4,138,835 2/1979 Takayanagi et al. .
4,437,718 3/1984 Selinko .
4,449,774 5/1984 Takashi et al. .
4,577,922 3/1986 Stipanuk et al. .
4,593,961 6/1986 Cosmo .

*Primary Examiner*—P. W. Echols
*Assistant Examiner*—Carl J. Arbes
*Attorney, Agent, or Firm*—John W. Cornell; Louis A. Hecht

[57] ABSTRACT

A connector assembly includes a stacked linear array of an alternating sequence of terminals and resiliently compressible insulator portions. The array is linearly compressed in an accordian-like fashion and is inserted in a housing having a cavity of length less than the uncompressed length of the array. The array is inserted in the housing and allowed to expand against opposing walls of the housing thereby maintaining the terminals in a self-compensating floating arrangement. A method for forming the connector assembly includes the steps of arranging resiliently compressible dielectric material between terminals to form a stacked linear array, linearly compressing the stacked linear array in an accordian-like fashion, inserting the compressed array in a housing, and thereafter maintaining the array in linear compression within the housing.

6 Claims, 5 Drawing Sheets

FIG.5a
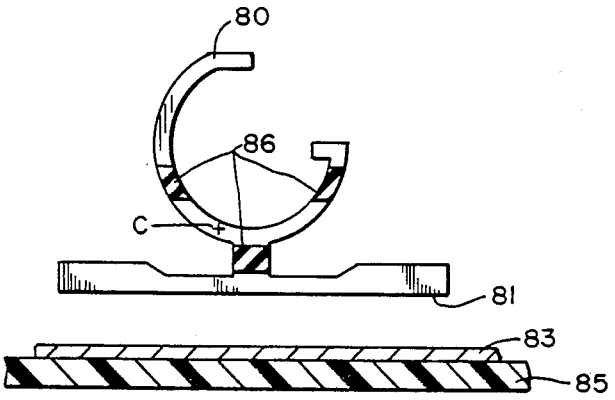
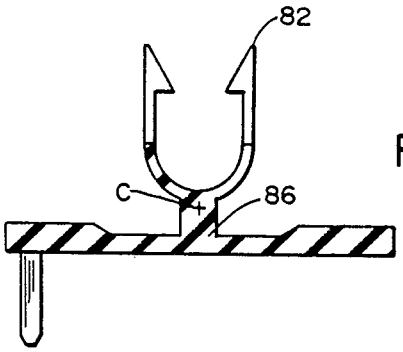
FIG.5b
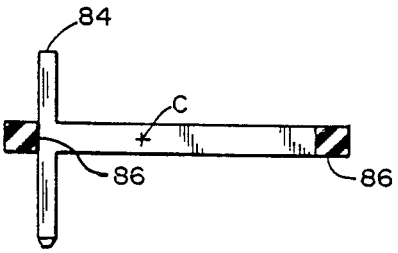
FIG.5c

ELECTRICAL CONNECTOR ASSEMBLY AND METHOD OF MAKING

This application is a division of application Ser. No. 818,160, filed Jan. 13, 1986, now abandoned.

BACKGROUND OF THE INVENTION

1. Field of the Invention

The present invention pertains to multi-circuit electrical connector arrangements which are mounted to an electronic device such as a printed circuit board, connector plug, or connector receptacle.

2. Description of the Prior Art

Multi-circuit electrical connectors of the type adapted for mounting on a printed circuit board or the like typically include a plurality or electrical terminals disposed within a unitary dielectric housing. Such housings typically totally surround the terminals, and provide inter-terminal barriers of insulation material.

Difficulties in maintaining the pitch or centerline spacing of terminals has been encountered with increasing connector miniaturization. Difficulties in pitch control arise because of the inherent physical properties of the inter-terminal dielectric material of which the housings are made. For example, it is well known that many plastics tend to swell somewhat with increasing humidity. Also, thicknesses of the metal stock from which terminals are formed can vary slightly from terminal to terminal. These and other like processes tend to deteriorate the dimensional tolerance of connector assemblies. Nonetheless, there is an increasing need to reduce the pitch or centerline spacing of electrical connector assemblies, including not only assemblies mounted on a printed circuit board, but also the connector assemblies found in connector plugs, connector receptacles, and other electronic devices.

Other difficulties have been encountered in providing connector arrangements for liquid crystal displays and the like. A liquid crystal display is typically a thin wafer-like electronic package encapsulated in glass. Because of its essentially two-dimensional configuration (i.e. its relatively thin construction), and because displays are elongated along a direction parallel to the mounted surface, it is difficult to provide effective simultaneous electrical connection with all segments of the display, while preventing stressing of the display which would cause the glass package to crack.

One arrangement typically provided for overcoming these difficulties is popularly known in the art as a "Zebra strip". An example of this connector arrangement is shown in U.S. Pat. No. 4,008,300 issued to Timothy Ponn. A method of producing this connector arrangement includes the steps of taking a dielectric sheet of resilient material such as natural or synthetic nonconductive rubber, and cutting the sheet to form a gasket-like frame against which the display is pressed. The cut frame is perforated with a series of holes for receiving discrete rod-like portions of resilient conductive material. The conductive material is in effect pressed into or otherwise formed within the dielectric rubber sheet. The display, when pressed against the dielectric sheet, is brought into intimate contact with the resilient conductive portions. Electrical leads of the display can conveniently be brought to an outside mating surface so as to be maintained in pressed engagement with the resilient conductive portions.

A convenient method for forming the conductive portions is to fill the holes with a slurry of electrically conductive material which is then allowed to cure, with constriction of the holes applying sufficient radial force to the resilient conductor portions to cause them to bulge outwardly beyond the surfaces of the dielectric rubber sheet. Such arrangements are, however, limited to compressive engagement with coextensive planar electronic devices.

More importantly, in commonly assigned U.S. Pat. No. 577,922, there is described a connector assembly adapted to electrically mate with an electronic device having closely spaced circuits, and a method for making a connector assembly. The connector assembly includes a generally linear terminal array having a plurality of spaced-apart metal terminals with dielectric means disposed on each terminal to provide insulation between adjacent terminals. Each terminal has a portion adapted to mate with a corresponding one of the closely spaced circuits on the electronic device.

SUMMARY OF THE INVENTION

Accordingly, it is an object of the present invention to provide a multi-circuit electrical connector assembly which provides greater pitch control in connectors of greatly reduced size and greatly reduced terminal centerline spacing.

Another object of the present invention is to provide a multi-circuit electrical connector assembly which compensates for changes in thicknesses of terminal members to provide a self-compensating centerline spacing, thereby to maintain a centerline spacing over a range of terminal thicknesses.

Yet another object of the present invention is to provide an electrical connector assembly or improved centerline spacing which can be incorporated in an electrical connector housing, such as that of an electrical connector plug or connector receptacle.

These objects are provided in a connector assembly adapted to electrically mate with an electronic device having closely spaced circuits, the connector assembly including a generally linear terminal array having a plurality of spaced-apart metal terminals with dielectric means disposed on each terminal to provide insulation between adjacent terminals, each terminal having a portion adapted to mate with a corresponding circuit. The improvement comprises a dielectric means including resiliently compressible material between adjacent sides of the terminals so that the terminal array is resiliently compressible in an accordian-like fashion, and housing means including a generally elongated terminal receiving cavity having a length lens than the uncompressed length of the array for mounting the array in linear compression, whereby the spacings between the terminals are self-compensating to allow for alignment with the circuits.

Still another object of the present invention is to provide a method of forming a connector assembly which provides improved control over centerline spacing of connector terminals, in a minimum number of steps which are simple and inexpensive to execute.

Another object of the present invention is to provide a method of assembling an electrical connector arrangement in which a stacked linear array of terminals are so positioned so as to minimize the effects of variations in terminal thicknesses on the terminal centerline spacing.

These and other objects of the present invention are provided in a method of forming a connector assembly for mating to an electronic device having closely spaced circuits, the connector assembly including a plurality of spaced-apart metal terminals, each having a portion adapted to mate with a corresponding circuit. The method comprises the steps of associating dielectric means with an outside surface of each terminal so that, when the terminals are stacked, insulation is provided between adjacent terminals, and arranging the terminals in a generally linear array. The improvement comprises providing resiliently compressible dielectric material between adjacent terminals, arranging the terminals and the dielectric material in a stacked linear array, linearly compressing the stacked linear array in an accordian-like fashion, inserting the compressed array in a housing, and maintaining the array in linear compression in said housing, whereby the spacings between the terminals are self-compensating to allow for alignment with the circuits.

BRIEF DESCRIPTION OF THE DRAWINGS

In the drawings, wherein like elements are referenced alike.

Figure 1:
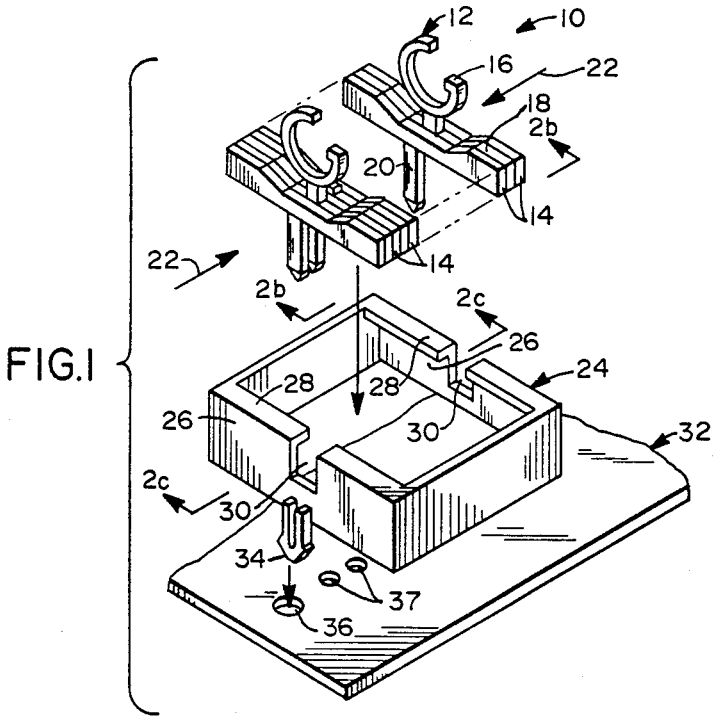
FIG. 1 is an exploded perspective view of the connector assembly of the present invention, shown mounted to a printed circuit board.
Figure 3:
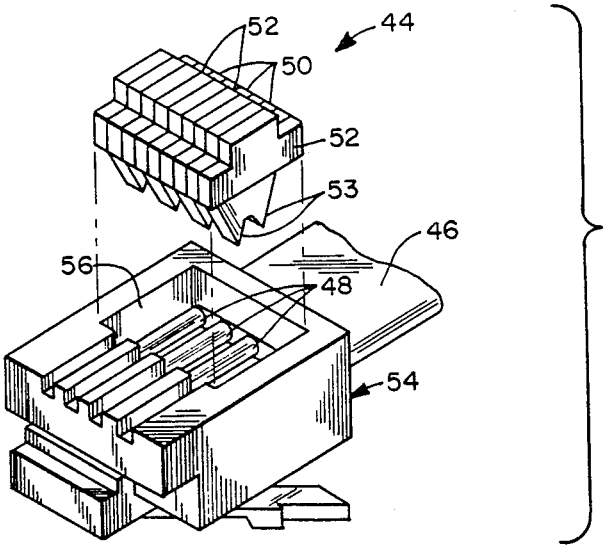
Figure 4:
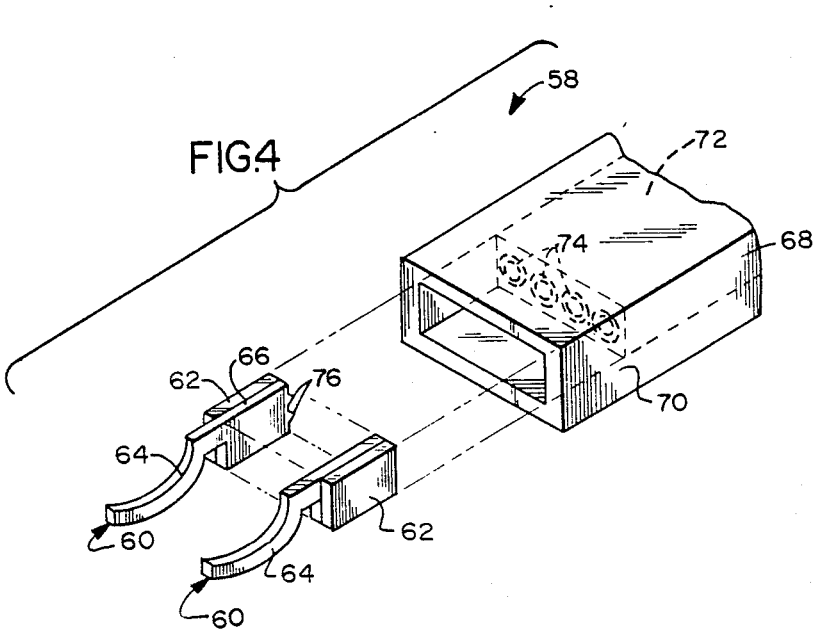
Figure 6:
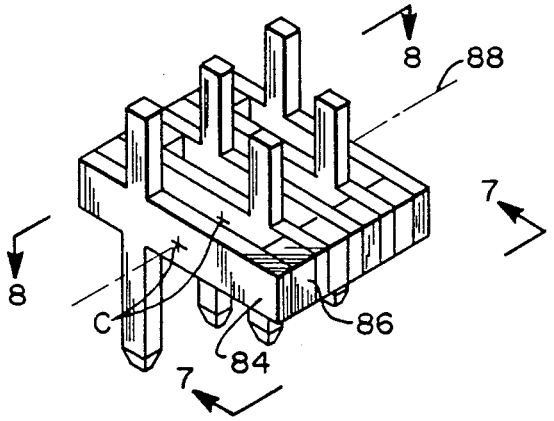

FIGS. *2a–2d* show the assembly of the connector of FIG. 1, wherein FIG. *2a* and *2b* show two different stacks of terminals having different thicknesses, FIG. *2c* shows the assembly one of the terminal stacks within a housing, and FIG. *2d* shows the completed connector assembly mounted on a printed circuit board;

FIG. 3 shows an exploded perspective view of a modular telephone plug constructed in accordance with the present invention;

FIG. 4 is an exploded perspective view of a receptacle connector constructed according to the principles of the present invention;

FIGS. *5a–5c* show three different terminals ready for assembly in a connector assembly constructed according to the present invention;

FIG. 6 shows a stacked terminal assembly according to the present invention, utilizing terminals similar to those shown in FIG. *5c;*

Figure 7:
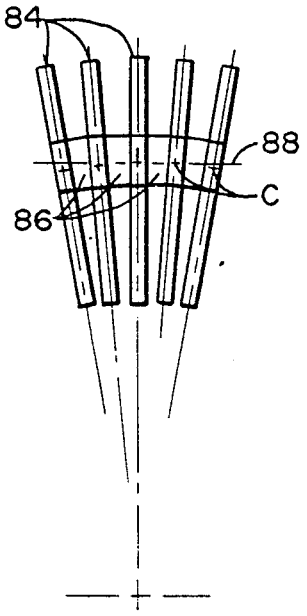
Figure 8:
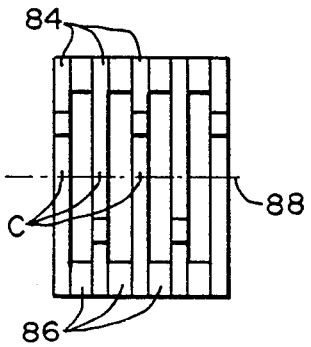
Figure 9:
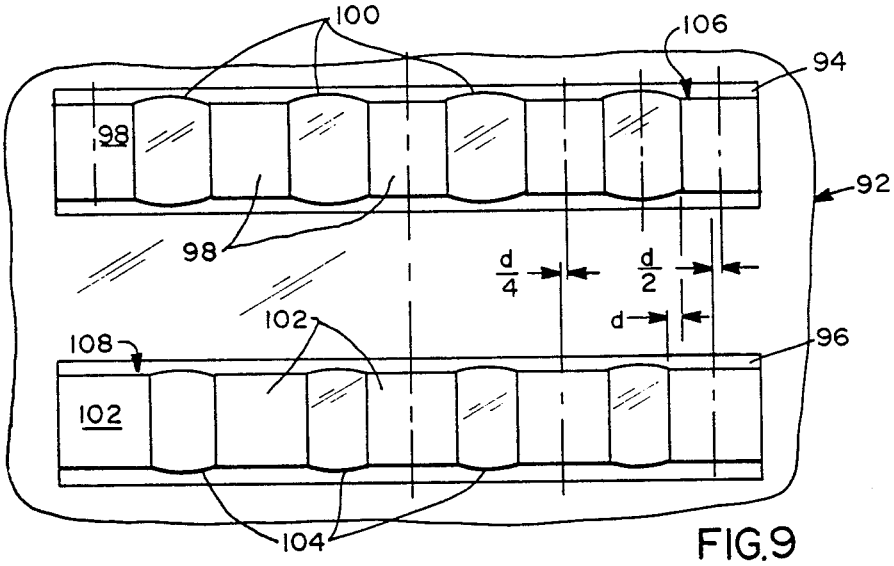
Figure 10:
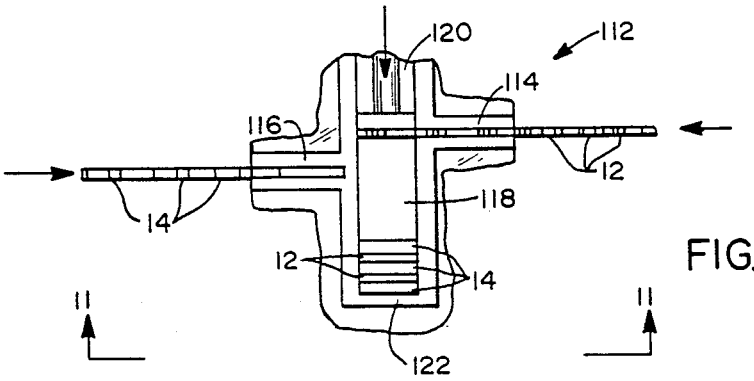
Figure 11:
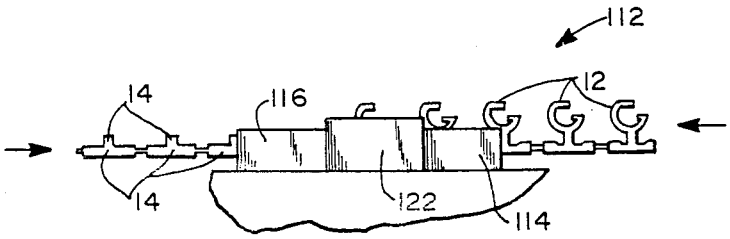

FIG. 7 is an elevational view of an improperly-formed stacked assembly of FIG. 6 showing, in exaggerated form, fan-out misalignment of that assembly;

FIG. 8 is a plan view of the assembly of FIG. 6;

FIG. 9 shows a plan view of two connector assemblies of the present invention, each having terminals of different thicknesses, illustrating the centerline control provided by the present invention;

FIG. 10 is a schematic plan view of a work station for assemblying a connector stack according to the present invention; and FIG. 11 is an elevation view of FIG. 10.

DETAILED DESCRIPTION OF THE PREFERRED EMBODIMENT

Figure 2:
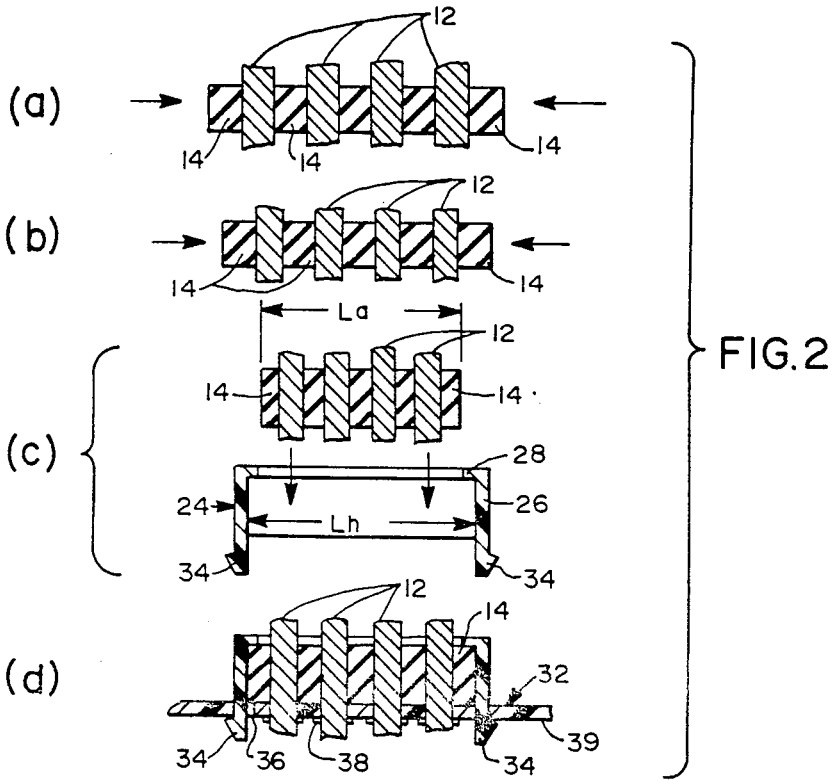

Referring now to the drawings, and especially to FIGS. 1 and 2, an electrical connector assembly according to the present invention is indicated generally at 10. Assembly 10 includes a generally linear array of spaced-apart metallic terminals 12 with layers of insulation 14 disposed between the terminals. Each terminal 12 has a generally C-shaped mating portion 16 adapted to mate with an edge of a printed circuit board, a board-engaging body portion 18 and a soldertail 20.

Insulation 14 disposed between adjacent terminals is, according to the present invention, comprised of a resiliently compressible material such as rubber. The material of insulation 14 is of a type which is compressible at least 20% of its bulk, so as to exhibit both an outwardly directed spring bias force, and a spring resistance to further inward compression.

The generally linear array of terminals 12 and insulation portions 14 is linearly compressed in the direction of arrows 22, in an accordian-like fashion, and inserted in a frame-like housing 24. Thereafter the array is allowed to expand in an outward direction against opposing walls 26 of housing 24. Housing 24 is dimensioned to maintain the array in partial linear compression so that insulator portions 14 bias terminals 12 for spring loaded, floating mounting. Housing 24 may include inwardly extending collar portions 28 which constrain the terminal body portions 18 against upward movement once installed in the housing. Also included in housing 24 are board-receiving slots 30 which cooperate with terminal mating portions 16 to receive an edge of a printed circuit board, as is known in the art.

Thereafter, the connector assembly 10 is advanced toward printed circuit board 32 such that mounting ears 34 of housing 24 are received in corresponding apertures 36 formed in board 32. Concurrently therewith, the soldertails 20 are received in corresponding apertures 37 where they are brought in close proximity with circuits or electrical traces 38 formed on the underside 39 of board 32 (see FIG. *2d*).

Referring now to FIG. 2, assembly of connector arrangement 10 will be described in greater detail. FIGS. *2a* and *2b* show two alternative stacked arrays of terminals 12 and insulation layers 14. The terminals 12 of FIG. *2a* are formed from slightly thicker metal stock than those of FIG. *2b*, the difference thickness being exaggerated for the purposes of illustration. In contrast, the terminals 12 of FIG. *2b* are formed from thinner stock. Either array, that of FIG. *2a* or of FIG. *2b*, may be encountered in a production environment. In either event, the array is linearly compressed to a final length La shown at the top of FIG. *2c*. The compressed array is inserted in housing 24, and allowed to expand against housing walls 26, which are spaced a distance Lh apart from each other. The final length Lh of the array is slightly larger than length La, but is significantly less than its uncompressed length by an amount which ensures at least 20% compression of the bulk of each insulator layer 14 to provide the required resilience for floating terminal mounting and automatic centerline self-compensation. According, to the present invention, the length Lh of housing 24 is carefully controlled to match the total length of the array of circuits 38 to which the terminals must be mated. The same housing 24 would be used for either array of FIG. *2a* or FIG. *2b*, even though the uncompressed lengths of those arrays may differ.

As will now become apparent, the terminals 12 of either array of FIG. *2a* or *2b* are mounted in a "floating" arrangement, owing to the resiliently compressible material 14. As will be explained in greater detail herein, the connector assembly of the present invention provides a self-compensating alignment of the terminals, which automatically adjusts for differences in manufacturing tolerances of terminal stock, insulation stock, or the dimensions of housing 24. Housing 24 is configured to overlie circuit traces 38 in a predetermined alignment therewith, when mounting ears 34 are received in apertures 36.

The resulting arrangement of FIG. 2*d* is ready for a soldered mating of terminal soldertails 20 to the circuits 38 of printed circuit board 32. Once terminals 12 are soldered in place, the resilient material 14 is relied upon to electrically isolate adjacent terminals 12 from each other.

With reference now to FIG. 3, the present invention is directed not only to connector assemblies for printed circuit boards, but also to connector assemblies for other electrical devices. For example, the electrical device shown in FIG. 3 comprises an electrical plug connector generally indicated at 44. The plug connector accepts a multiconductor cable 46 containing a plurality of circuits in the form of insulation-clad electrical conductors 48. As before, terminals 50 are spaced apart in a linear array by resiliently compressible insulator portions 52. Terminals 50 are of a type known in the modular telephone connector art, and include insulation piercing tips 53 for penetrating the insulation of conductors 48.

Connector 44 inludes a housing 54 formed of molded dielectric material. Housing 54 includes a frame-like portion 56 overlying the circuits or conductors 48, of cable 46. The array of terminals 50 and insulator portions 52 is linearly compressed, and inserted into the frame-like portion 56, in a manner similar to that illustrated in FIG. 2.

The frame portion 56 of housing 54 may be of sufficient array receiving depth to allow the terminals 50 of the array to be received between opposing frame walls, before insulation piercing portions 53 are driven into insulation-clad conductors 48 (whereupon terminals 50 will be fixed in position, unable to float). If this extra depth cannot be provided in frame 56, then application tooling must be provided to linearly compress the array, and hold the array in linear compression as insulating piercing tips 53 are driven into conductors 48. Terminals 50 will be free to float within the application tooling prior to termination to conductors 48, it being understood that the application tooling must, in part, consist of a frame similar to the frame 56 of housing 54.

Referring now to FIG. 4, an alternative embodiment of a plug connector according to the present invention is indicated generally at 58. The connector arrangement includes a plurality of spaced-apart terminals 60 spaced apart by resiliently compressible material 62 disposed between each terminal. Terminals 60 include a forward mating portion 64 and a body portion 66. Mating portion 64 is of a type providing a downwardly directed spring bias force for mating with the edge of a printed circuit board, flat flexible cable, or a flag-type terminal. The array of terminals 60 and insulators 62 is, as explained before, linearly compressed and inserted in a dielectric housing 68. A frame-like portion 70 of housing 68 is provided to receive the compressed array.

Terminals 60 are adapted to mate wtih circuits disposed within housing 68. For example, housing 68 can be made to accept a cable 72, similar to the cable 46 described with reference to FIG. 3. Cable 72 includes a plurality of individual circuit conductors 74. The rearward ends of terminals 60 conveniently include piercing tips 76 which provide axial penetration of conductor 74, as the array is inserted in housing 68. Other electrical mating arrangements between terminals 60 and circuits carried within housing 68 will become apparent to those skilled in the art upon study of the description herein.

In each of the several embodiments discussed above, the linear array of terminals and resiliently compressible insulator portions is linearly compressed to a foreshortened length to allow insertion in a frame-like housing. In each embodiment, the terminals are free to float when installed in the frame-like housing, owing to the compressible resilience of the insulator material.

Referring now to FIGS. 5*a*–5*c*, three different terminals 80, 82, 84, respectively are shown. The terminal 80 is of the surface mount type, having an engaging surface 81 adapted for soldered surface mounting to a conductive pad 83 affixed to the surface of substrate 85. FIGS. 5*a*–5*c* illustrate alternative configurations of resiliently compressible insulation material 86 provided between terminals. In each of the figures, the terminals are assumed to be of equal thickness throughout their cross section. The centroid, or center of each cross-sectional area of each terminal can be mathematically computed, and is shown in its approximate position by the reference letter "C". According to the present invention, the resiliently compressible material 86 is applied to each terminal such that, upon linear compression in a stacked array (as explained above with reference to FIG. 2), the net forces applied to each terminal will be balanced about the centroid of the terminal cross-section. This is achieved in a variety of ways, the diversity of which is illustrated in the different FIGS. 5*a*–5*c*.

For example, referring to FIG. 6, terminals similar to those of FIG. 5*c* are shown in a stacked linear array. If the forces are not balanced about the cross-sectional centroid of each terminal 84, a fan-out misalignment of terminals 84 will result, as shown in the elevation view of FIG. 7. The misalignment is shown in a vertical plane of FIG. 7, it being understood that misalignment can also occur in a perpendicular, horizontal plane when insulation material 86 is improperly applied in an unbalanced fashion. However, centroid balancing can be readily achieved, such that horizontal fan-out misalignment does not occur, as shown in the plan view of FIG. 8. In FIGS. 6–8, the line 88 lies along the cross-section centroid "C" of each terminal 84 of the linear array.

Referring now to FIG. 9, the self-compensating, or self-centering feature provided by the present invention will be described in greater detail. FIG. 9 is a plan view of a housing 92 having two frame-like array-receiving recesses 94, 96 respectively. An array of terminals 98 and resiliently compressible insulator portions 100 is shown in the upper portion of FIG. 9, installed in recess 94. Similarly, a linear array of terminals 102 and resiliently compressible insulator portions 104 is shown installed in lower recess 96. Recesses 94, 96 are similarly dimensioned, but the terminals 102 are (shown to an exaggerated degree) wider or thicker than the terminals 98, by an amount "d". As a result, the resiliently compressible insulators 104 are compressed to a greater extent than insulators 100. For convenience in further description, the array of terminals and insulators mounted in recess 94 will be designated by the numeral 106 while the array mounted in recess 96 will be designated by the numeral 108.

In the particular arrangement shown in FIG. 9, insulator portions are not provided at the ends of the several arrays 106, 108. Consequently, the outside end surfaces of each stacked array 106, 108 will be precisely aligned with each other. Due to the difference in thickness "d" between terminals 98, 102, the centerline positions of the end terminals will not be colinearly aligned. However, misalignment will not be great as the full thickness difference "d". In fact, the difference in centerline positions of end terminals is of thickness ½d. When an odd number of terminals are provided in a given linear stacked array, the centerline positions of the central terminals will, with the present invention, always be colinearly aligned regardless of variation in terminal thicknesses or insulator thicknesses. The remaining ("intermediate") terminals of an array will have their centerline positions displaced or offset by a fraction of the thickness difference "d". For example, in the five terminal arrangements shown in FIG. 9, the centerline offsets of the "intermediate" terminals (those not at the end or the center of a stacked linear array) will be offset by the difference one-fourth d. If eleven terminals were provided the offset difference of intermediate terminal centerlines would be offset one-tenth d.

Thus, according to the present invention, the center or central terminals would always be identically placed, the end terminals would be offset at most by a distance ½d, and the remaining intermediate terminals would have an average centerline offset significantly smaller than the assumed difference d--that is, the remaining ½d offset is spread out or averaged over the number of intermediate terminals. The same averaging principle applies to even quantities of terminals.

Referring now to FIG. 10, an arrangement for making the connector assembly of the present invention is generally indicated at 112. Work station 112 includes a first feed track 114 for the terminals 12, which are conveniently stamped from a unitary metal blank, being formed in an end-to-end reelable configuration as shown in the elevation view of FIG. 11. Similarly, work station 112 includes a second feed track 116 for supplying a plurality of insulator portions 14 which are conveniently provided by stamping an integral blank of resiliently compressible material to produce connector portions 14 arranged end-to-end in a reelable configuration. Cutting blades not shown in the figure are provided at each feed tack to sever individual terminals 12 and individual insulator portions 14. Upon severing, an individual terminal 12 is inserted in a generally U-shaped forming track 118 (see FIG. 10) where it is pushed by plunger 120 against a stop wall 122 formed at the bight of the forming track 118. Thereafter, an individual insulator portion 14 is formed, and introduced into forming track 118. Plunger 120 pushes the insulator portion 14 against the previously-formed terminal 12. In this manner, a linear array of terminals 12 and insulator portions 14 is conveniently stacked in forming track 118.

The stacked linear array can thereafter be relocated to an insertion station where it is loaded in one of the aforedescribed frame-like housings. If desired, a stripe of binder material such as varnish can be applied across a stacked array in the direction of stroke of plunger 120 to hold the array together as a free standing, but freely compressible assembly, it being understood that the binder material would not impede the linear compression of insulator portions 14 in their final application.

As shown in FIGS. 10 and 11, it is prefered that the sequential succession of terminals is preserved in the resulting stacked linear array, and likewise the sequential succession of insulator portions 14 is also preserved within that array. This ensures a minimum offset in centerline terminal positions, due to variations in the blank material from which the terminals and/or insulating portions 14 are formed.

We claim:

1. In a low pitch, high density electrical connector mateable with an electronic device having a large number of closely-spaced circuits, said connector including a generally linear laminate having a pair of opposed ends and a normal length, L1, said laminate including a plurality of electrically conductive terminals and a plurality of dielectric interlayers effective to electrically insulate adjacent terminals; and housing means including a laminate-receiving cavity having a pair of opposed end walls defining a cavity length, L2, the improvement comprising:

the interlayers being formed of a pitch-controlling amount of resiliently compressible dielectric material;

L2 is less than L1; and said laminate being mounted in said cavity in a linearly compressed state such that the opposed ends of the laminate resiliently abut the opposed end walls in said cavity, whereby, a connector substantially compliant to manufacturing tolerances exhibiting improved terminal centerline to centerline pitch control for mating is provided.

2. A connector as in claim 1, wherein each electrically conductive terminal comprises a stamped metal terminal.

3. A connector as in claim 1, wherein each electrically conductive terminal includes a contact portion mateable with one of said closely-spaced circuits in said electronic device.

4. A connector as in claim 3, wherein said electronic device is a printed circuit board having a plurality of conductive mating regions defined thereon associated with each of said circuits and said terminal contact portion is selected from a solder tail contact or a surface mount contact surface adapted for electrical connection with the conductive mating regions.

5. A connector as in claim 3, wherein said housing means comprises a plug connector, said terminal contact portions comprise insulation-penetrating portions and said closely-spaced circuits comprise a plurality of insulation clad electrical wires mounted in said plug connector, disposed for electrical engagement by said insulation penetrating portions when the laminate is inserted into the laminate receiving cavity.

6. A method for making a connector mateable with an electronic device having a large number of closely spaced circuits, the connector including a generally linear laminate including a plurality of electrically conductive terminals and a plurality of dielectric interlayers effective to electrically insulate adjacent terminals and housing means including a laminate receiving cavity, the method including the steps of:

providing a housing means including a laminate receiving cavity having a length, L2;

assembling a generally linear laminate including a plurality of electrically conductive terminals and a plurality of dielectric insulators effective to electrically insulate adjacent terminals having a normal length, L1; and inserting said laminate in said laminate-receiving cavity;

the improvement comprising:

providing as the dielectric insulators a pitch controlling amount of a resiliently compressible dielectric material so that said laminate has a normal length, L1, which is greater than L2;

linearly compressing the laminate;

mounting the compressed laminate by inserting it into the housing cavity; and maintaining the mounted laminate in compression in said housing means;

whereby, the centerline spacings between the terminals are self balancing to provide improved alignment for mating with said closely spaced circuits.

* * * * *